US009637952B2

(12) United States Patent
Wittelsbuerger et al.

(10) Patent No.: US 9,637,952 B2
(45) Date of Patent: May 2, 2017

(54) MOTOR VEHICLE LOCK

(71) Applicant: Brose Schliesssysteme GmbH & Co. KG, Wuppertal (DE)

(72) Inventors: Michael Wittelsbuerger, Lake Orion, MI (US); David Rosales, Rochester Hills, MI (US)

(73) Assignee: Brose Schliesssysteme GmbH & Co. KG, Wuppertal (DE)

( * ) Notice: Subject to any disclaimer, the term of this patent is extended or adjusted under 35 U.S.C. 154(b) by 167 days.

(21) Appl. No.: 13/929,205

(22) Filed: Jun. 27, 2013

(65) Prior Publication Data

US 2014/0284941 A1 Sep. 25, 2014

Related U.S. Application Data

(60) Provisional application No. 61/804,914, filed on Mar. 25, 2013.

(51) Int. Cl.
*E05C 3/06* (2006.01)
*E05B 77/06* (2014.01)
(Continued)

(52) U.S. Cl.
CPC ..... *E05B 77/06* (2013.01); *E05B 77/02* (2013.01); *E05B 77/04* (2013.01); *E05B 77/12* (2013.01);
(Continued)

(58) Field of Classification Search
CPC ..... E05B 77/02; E05B 77/04; E05B 77/06; E05B 77/12; Y10S 292/22
(Continued)

(56) References Cited

U.S. PATENT DOCUMENTS 3,799,596 A * 3/1974 Nozomu et al. ..... 292/216
4,382,622 A 5/1983 Ishikawa et al.
(Continued)

FOREIGN PATENT DOCUMENTS

DE 19511651 A1 * 10/1995 ..... E05B 65/42
DE 19738492 A1 * 3/1998 ..... E05B 65/42
(Continued)

OTHER PUBLICATIONS

Amendment and Response to Non-Final Office Action mailed Mar. 26, 2015 for U.S. Appl. No. 13/950,033, submitted via EFS-Web on Aug. 26, 2015, 12 pages.
(Continued)

*Primary Examiner* — Carlos Lugo
(74) *Attorney, Agent, or Firm* — Pauly, Devries, Smith & Deffner, LLC

(57) ABSTRACT

The invention is directed to lock for a vehicle door arrangement, wherein a catch and a pawl are provided. The catch can be brought into an opening position and into a closed position, wherein the catch, which is in the closed position, is or may be brought into holding engagement with a lock striker. The pawl may be brought into an engagement position. A pawl actuation lever is provided for deflecting the pawl into the release position. A switchable coupling arrangement comprises a first coupling lever on the side of the pawl actuation lever, a second coupling lever on the side of the pawl and a moveable coupling element that may be moved into a closing position for a coupling engagement with the two coupling levers and into an opening position for decoupling the two coupling levers. The coupling element is arranged on one of the two coupling levers.

14 Claims, 5 Drawing Sheets

(51) Int. Cl.

| | |
|---|---|
| *E05C 3/16* | (2006.01) |
| *E05B 77/12* | (2014.01) |
| *E05B 77/04* | (2014.01) |
| *E05B 77/02* | (2014.01) |

(52) U.S. Cl.
CPC ..... *Y10S 292/22* (2013.01); *Y10T 292/0908* (2015.04); *Y10T 292/0949* (2015.04)

(58) Field of Classification Search
USPC ..... 292/216, DIG. 22
See application file for complete search history.

(56) References Cited

U.S. PATENT DOCUMENTS

| | | | | |
|---|---|---|---|---|
| 4,995,654 | A | 2/1991 | Nishigami et al. | |
| 5,865,481 | A * | 2/1999 | Buschmann | 292/216 |
| 6,971,688 | B2 | 12/2005 | Drysdale et al. | |
| 7,607,702 | B2 * | 10/2009 | Pereverzev | 292/216 |
| 8,303,004 | B2 * | 11/2012 | Lee et al. | 292/216 |
| 8,398,128 | B2 * | 3/2013 | Arabia et al. | 292/216 |
| 8,485,570 | B2 * | 7/2013 | Konchan | 292/194 |
| 8,967,678 | B2 | 3/2015 | Rosales et al. | |
| 2003/0234544 | A1 | 12/2003 | Jankowski et al. | |
| 2009/0322105 | A1 | 12/2009 | Lee et al. | |
| 2010/0283268 | A1 | 11/2010 | Cumbo | |
| 2011/0181052 | A1 | 7/2011 | Brose et al. | |
| 2012/0110920 | A1 | 5/2012 | Takagi et al. | |
| 2012/0313384 | A1 * | 12/2012 | Cumbo et al. | 292/199 |
| 2013/0015670 | A1 | 1/2013 | Perkins et al. | |
| 2014/0035295 | A1 * | 2/2014 | Bendel et al. | 292/100 |
| 2014/0132008 | A1 * | 5/2014 | Bendel et al. | 292/92 |
| 2014/0312630 | A1 * | 10/2014 | Bendel et al. | 292/195 |
| 2015/0028601 | A1 * | 1/2015 | Rosales et al. | 292/92 |

FOREIGN PATENT DOCUMENTS

| | | | |
|---|---|---|---|
| DE | 202009009061 | | 1/2011 |
| FR | 2970680 | A1 * | 7/2012 |

OTHER PUBLICATIONS

European Search Report for corresponding application US13.5033EP, mailed May 4, 2015 (4 pages).
Final Office Action for U.S. Appl. No. 13/950,033 mailed Oct. 8, 2015 (17 pages).
Non-Final Office Action for U.S. Appl. No. 13/950,033, mailed Mar. 26, 2015 (20 pages).
Non-Final Office Action for U.S. Appl. No. 13/950,033, mailed Mar. 10, 2016 (18 pages).
Amendment and Response to Non-Final Office Action mailed Apr. 14, 2016, for U.S. Appl. No. 14/136,759, submitted via EFS-Web on Sep. 14, 2016, 13 pages.
Amendment and Response to Non-Final Office Action mailed Mar. 10, 2016 for U.S. Appl. No. 13/950,033, submitted via EFS-Web on Aug. 22, 2016, 9 pages.
Final Office Action for U.S. Appl. No. 13/950,033 mailed Nov. 3, 2016 (21 pages).
Non-Final Office Action for U.S. Appl. No. 13/929,205, mailed Apr. 14, 2016 (15 pages).

* cited by examiner

MOTOR VEHICLE LOCK

CLAIM OF PRIORITY

This application claims the benefit of priority, under 35 U.S.C. Section 119(e), to U.S. Provisional Application No. 61/804,914, filed Mar. 25, 2013, which is hereby incorporated by reference herein in its entirety.

FIELD OF THE INVENTION

The invention is directed to a motor vehicle lock for a motor vehicle door arrangement according.

BACKGROUND

The motor vehicle lock in question is assigned to a motor vehicle door arrangement which comprises at least a motor vehicle door. The expression "motor vehicle door" is to be understood in a broad sense. It includes in particular side doors, back doors, lift gates, trunk lids or engine hoods. Such a motor vehicle door may generally be designed as a sliding door as well.

The crash safety plays an important role for today's motor vehicle locks. It is of particular importance that neither crash induced acceleration nor crash induced deformation leads to an unintended opening of the motor vehicle door which the motor vehicle lock is assigned to. The focus of the present application is to prevent an unintended opening of the motor vehicle door based on crash induced acceleration. In case of a side impact on the motor vehicle the outer door handle may be reluctant to follow the impact due to mass inertia of the outer door handle. As a result a relative movement between the outer door handle and the motor vehicle door occurs, which again may lead to an unintended opening of the motor vehicle door.

The known motor vehicle lock (US 2011/0181052 A1), which is the starting point for the invention, is provided with the usual locking elements catch and pawl, wherein the pawl may be deflected into a release position by actuation of a pawl actuation lever.

The known motor vehicle lock also comprises a lock mechanism which may be brought into different functional states such as "unlocked" and "locked" by the user. The pawl may be deflected into its released position by an outer door handle, which is connected to the pawl actuation lever, if the lock mechanism is in its unlocked state. With the lock mechanism being in its locked state an actuation of the pawl actuation lever runs free.

To guarantee a high crash safety the known motor vehicle lock comprises a crash element which is a separate component from the pawl actuation lever. By the accelerations which occur during a crash the crash element moves into a blocking position in which the crash element blocks further actuation of the pawl actuation lever.

One disadvantage of the known motor vehicle lock is the fact that before the intended blocking of the pawl actuation lever takes place, the crash element has to perform the above noted movement into the blocking position. The necessity of the movement of the crash element before the intended blocking takes place leads to undesirable reaction times of the crash safety function.

Furthermore, for the known motor vehicle lock, the constructional design of the drive train between the door handle and the pawl appears to be challenging. This is true as in a crash situation the whole drive train starting from the door handle is being blocked. In order not to run the risk of an unpredictable breakage of the drive train, this drive train has to be designed for exceptionally high forces, which leads to high material and production costs.

SUMMARY

It is the object of the invention to improve the known motor vehicle lock such that a cost effective constructional design is possible without reducing the resulting crash safety.

The above noted object is solved for a motor vehicle lock for a motor vehicle door arrangement, wherein a catch and a pawl, which is assigned to the catch, are provided, wherein the catch can be brought into an opening position and into a closed position, wherein the catch, which is in the closed position, is or may be brought into holding engagement with a lock striker, wherein the pawl may be brought into an engagement position, in which it is in blocking engagement with the catch wherein the pawl may be deflected into a release position, in which it releases the catch, wherein a pawl actuation lever is provided for deflecting the pawl into the release position, wherein a switchable coupling arrangement is provided between the pawl actuation lever and the pawl, wherein the switchable coupling arrangement comprises a first coupling lever on the side of the pawl actuation lever, a second coupling lever on the side of the pawl and a moveable coupling element that may be moved into a closing position for a coupling engagement with the two coupling levers and into an opening position for decoupling the two coupling levers, wherein the coupling element is arranged on one of the two coupling levers and that releasing the pawl actuation lever from its actuated state into its non-actuated state causes engagement of a control surface of the coupling element with a counter control surface such that the coupling element is forced into its opening position and that deflecting the pawl actuation lever from its non-actuated state into its actuated state releases the coupling element into its closing position.

First of all it is important that releasing the pawl actuation lever from its actuated state into its non-actuated state causes the switchable coupling arrangement to be moved into its opening state. Once the pawl actuating lever is being actuated the coupling element is released into its closing position. If designed accordingly, during normal operation, the actuation of the pawl actuation lever always goes along with moving the coupling element into its closing position such that in the end the actuation of the pawl actuating lever causes the deflection of the pawl into its release position.

However, the proposed motor vehicle lock may be configured such that during very fast actuation of the pawl actuation lever the coupling element does not reach its closing position quick enough in order to deflect the pawl into its release position. This is very useful in a crash situation as crash accelerations often lead to very fast actuation of the pawl actuation lever. As the delay of the coupling element reaching its closing position mainly goes back on mass inertia regarding the mass of the coupling element, this delay may easily configured by choosing a corresponding weight distribution at the coupling element.

The above noted characteristics of the proposed motor vehicle lock regarding the actuation of the pawl actuation lever may be achieved with a simple and thereby cost efficient construction. This is because the coupling element is not only used for coupling the two coupling levers of the switchable coupling arrangement but is also used for controlling its own movement between the opening position and the closing position. In this respect it is proposed that the coupling element comprises a control surface and that releasing the pawl actuation lever from its actuated into its non-actuated state causes engagement of the control surface with a counter control surface such that the coupling element is moved into its opening position. This double use of the coupling element leads to a reduction of components which again leads to a cost efficient construction.

In a preferred embodiment the pawl actuation lever and a pawl release lever connected to the pawl are part of the switchable coupling, those two components being coupled by the coupling element as far as the coupling element is in its closing position. If the coupling element is arranged on the second coupling lever on the side of the pawl, here and preferably, on the pawl release lever, the coupling element is not fixedly connected to the pawl actuation lever.

Accordingly, if the switchable coupling arrangement is pretensioned into the closing state and/or that the coupling element is pretensioned into the closing position, the coupling element may freely follow the actuation movement of the pawl actuation lever, which following movement of the coupling element may be delayed by mass inertia as explained above.

In the further preferred embodiment, the counter control surface is arranged at the pawl release lever or even at the pawl itself. In both cases the result is that the complete function of the switchable coupling arrangement is concentrated on the two coupling levers and the coupling element which again is arranged on one of those two coupling levers. In the end geometrical tolerances, for example geometrical tolerances regarding the housing of the motor vehicle lock, do not play a role for proper functioning of the switchable coupling arrangement.

In an embodiment of a motor vehicle lock, deflecting the pawl actuation lever from its non-actuated state into its actuated state with a rapidity that is above threshold rapidity, the pawl actuation lever runs free due to the mass inertia based in closing of the switchable coupling arrangement. With this configuration it is guaranteed that the actuation of the pawl actuation lever, which is performed with a rapidity above a certain threshold rapidity, leads to the pawl actuation lever running free without deflecting the pawl into its release position.

A compact construction may be achieved with the preferred embodiment which proposes to use the switchable coupling arrangement to bring the lock mechanism into different functional states such as "unlocked" and "locked". With this additional idea the switchable coupling arrangement not only has a crash safety function, but also a locking/unlocking function.

In an embodiment the invention provides a motor vehicle lock for a motor vehicle door arrangement, wherein a catch and a pawl, which is assigned to the catch, are provided, wherein the catch can be brought into an opening position and into a closed position, wherein the catch, which is in the closed position, is or may be brought into holding engagement with a lock striker, wherein the pawl may be brought into an engagement position, in which it is in blocking engagement with the catch wherein the pawl may be deflected into a release position, in which it releases the catch, wherein a pawl actuation lever is provided for deflecting the pawl into the release position, wherein a switchable coupling arrangement is provided between the pawl actuation lever and the pawl, wherein the switchable coupling arrangement comprises a first coupling lever on the side of the pawl actuation lever, a second coupling lever on the side of the pawl and a moveable coupling element that may be moved into a closing position for a coupling engagement with the two coupling levers and into an opening position for decoupling the two coupling levers, wherein the coupling element is arranged on one of the two coupling levers and that releasing the pawl actuation lever from its actuated state into its non-actuated state causes engagement of a control surface of the coupling element with a counter control surface such that the coupling element is forced into its opening position and that deflecting the pawl actuation lever from its non-actuated state into its actuated state releases the coupling element into its closing position.

In one embodiment, the coupling element is arranged on the second coupling lever on the side of the pawl.

In one embodiment, the coupling element is pivotable on the second coupling lever on the side of the pawl.

In one embodiment, the first coupling lever is the pawl actuation lever and that the second coupling lever is one of a pawl release lever connected to the pawl and the pawl.

In one embodiment, the switchable coupling arrangement is pretensioned into the closing state such that deflecting the pawl actuation lever from its non-actuated state into its actuated state in normal operation causes closing of the switchable coupling arrangement.

In one embodiment, the coupling element is pretensioned into the closing position such that deflecting the pawl actuation lever from its non-actuated state into its actuated state in normal operation causes closing of the switchable coupling arrangement.

In one embodiment, the counter control surface is arranged at the pawl release lever or the pawl itself.

In one embodiment, with the pawl actuation lever being in the non-actuated state closing the switchable coupling arrangement is being blocked by the engagement of the control surface and the counter control surface.

In one embodiment, the pawl actuation lever is pretensioned into the non-actuated state.

In one embodiment, deflecting the pawl actuation lever from its non-actuated state into its actuated state with a rapidity that is above a threshold rapidity, the pawl actuation lever runs free due to the mass inertia based delay in closing of the switchable coupling arrangement.

In one embodiment, the actuation of the pawl actuation lever comprises a release section of movement of the pawl actuation lever, during which the coupling element is being released to move into its closing position, and a subsequent pawl deflecting section of movement of the pawl actuation lever, during which the pawl is being deflected into its released position if the coupling element has reached its closing position during the release section of movement.

In one embodiment, the mass inertia based delay in closing of the switchable coupling arrangement goes back mainly on the weight distribution of the coupling element.

In one embodiment, the pawl actuation lever and the pawl release lever are pivotable around one and the same geometrical pivot axis.

In one embodiment, a lock mechanism is provided, which may be brought into different functional states such as "unlocked" and "locked" via a lock actuation arrangement and wherein the lock mechanism acts on the switchable coupling arrangement for realizing the functional states "unlocked" and "locked" such that in the functional state "unlocked" the switchable coupling arrangement closes and in the functional state "locked" opens.

In one embodiment, a crash causes deflecting the pawl actuation lever from its non-actuated state into its actuated state with a rapidity that is above a threshold rapidity.

BRIEF DESCRIPTION OF THE FIGURES

In the following the invention will be described in an example referring to the drawings. In the drawings show FIG. 1 selected parts of a proposed motor vehicle lock in a perspective view basically on the front side, FIG. 2 the switchable coupling arrangement of the motor vehicle lock according to FIG. 1 in an exploded view, FIG. 3 the motor vehicle lock according to FIG. 1 in a backside view with non-actuated pawl actuation lever, FIG. 4 the motor vehicle lock according to FIG. 1 in a backside view during actuation of the pawl actuation lever in normal operation and FIG. 5 the motor vehicle lock according to FIG. 1 in backside view during actuation of the pawl actuation lever, which actuation is induced by a crash situation.

DETAILED DESCRIPTION

Figure 1:
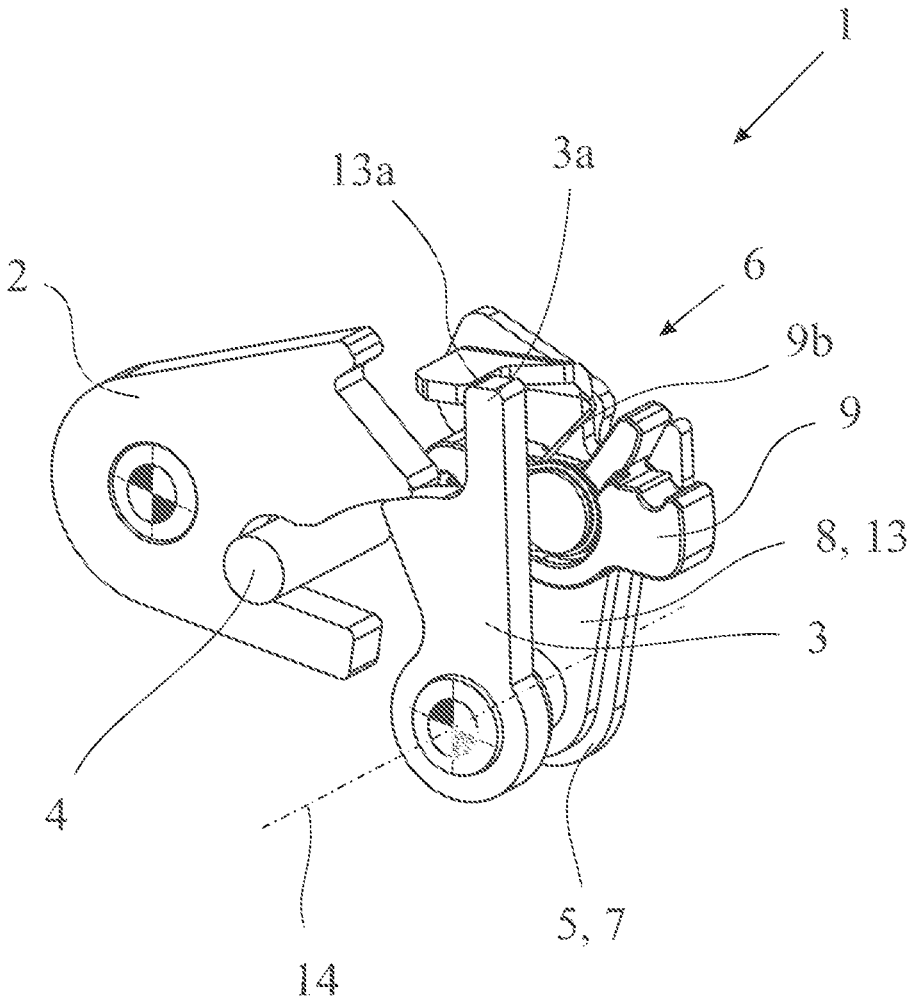

The motor vehicle lock 1 shown in the drawings is assigned to a motor vehicle door arrangement, which comprises a motor vehicle door (not shown) besides said motor vehicle lock 1. Regarding the broad interpretation of the expression "motor vehicle door" reference is made to the introductory part of the specification. Here and preferably the motor vehicle door is a side door of the motor vehicle.

The motor vehicle lock 1 comprises the usual locking elements catch 2 and pawl 3, which is assigned to the catch 2. The catch 2 can be brought into an open position (not shown) and into a closed position (FIG. 1). In the closed position shown in FIG. 1 the catch 2 is or may be brought into holding engagement with a lock striker 4 that is indicated in FIG. 1 as well. The motor vehicle lock 1 is normally arranged at or in the motor vehicle door, while the lock striker 4 is arranged at the motor vehicle body.

The pawl 3 may be brought into an engagement position shown in FIG. 1, in which it is in blocking engagement with the catch 2. Here and preferably the pawl 3 blocks the catch 2 in its closed position in a mechanically stable manner such that the pawl 3 itself does not have to be blocked. For release of the catch 2 into its open position the pawl 3 may be deflected into a release position (not shown), which would be a deflection in the clockwise direction in FIG. 1.

Figure 2:
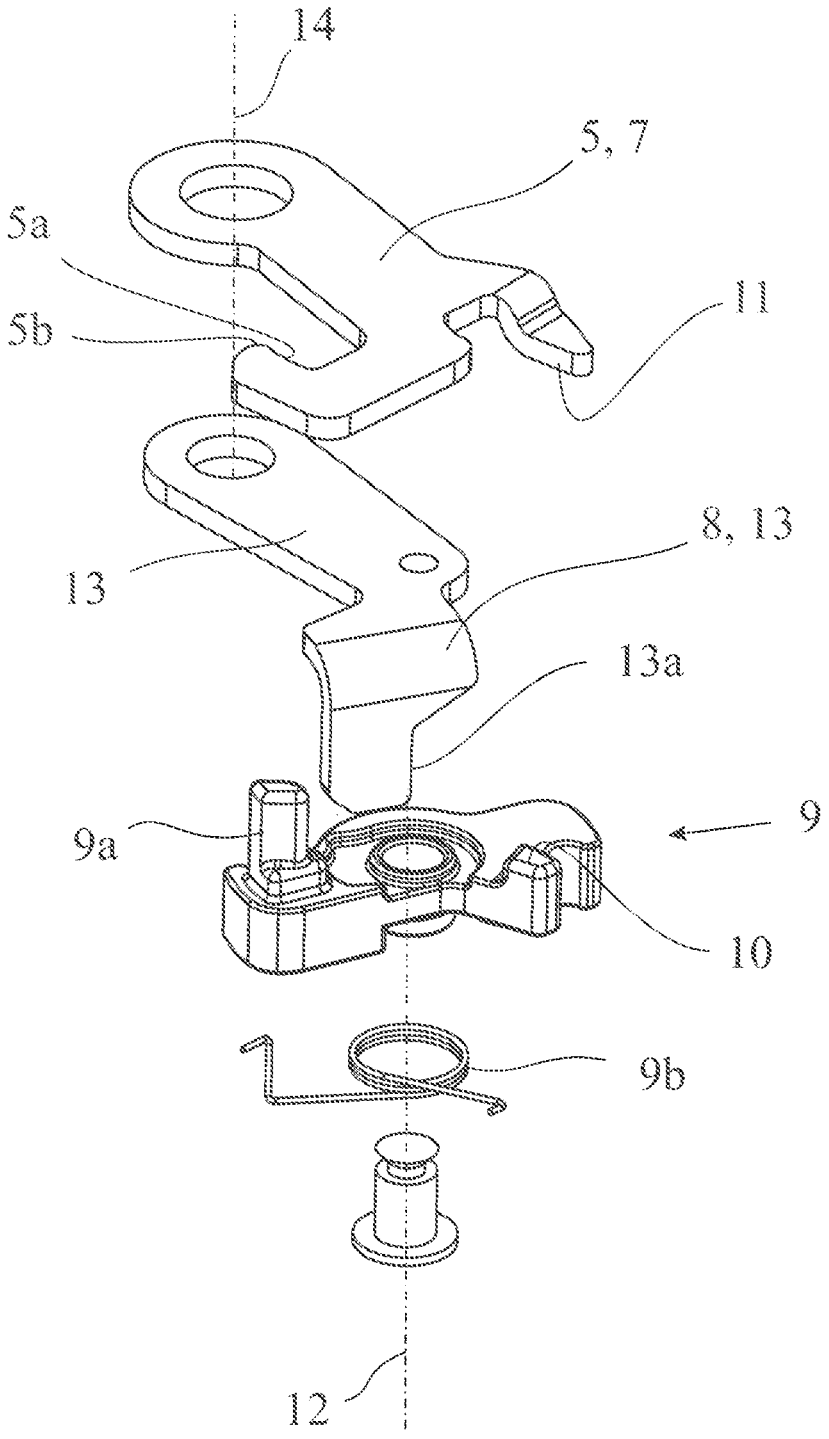
Figure 3:
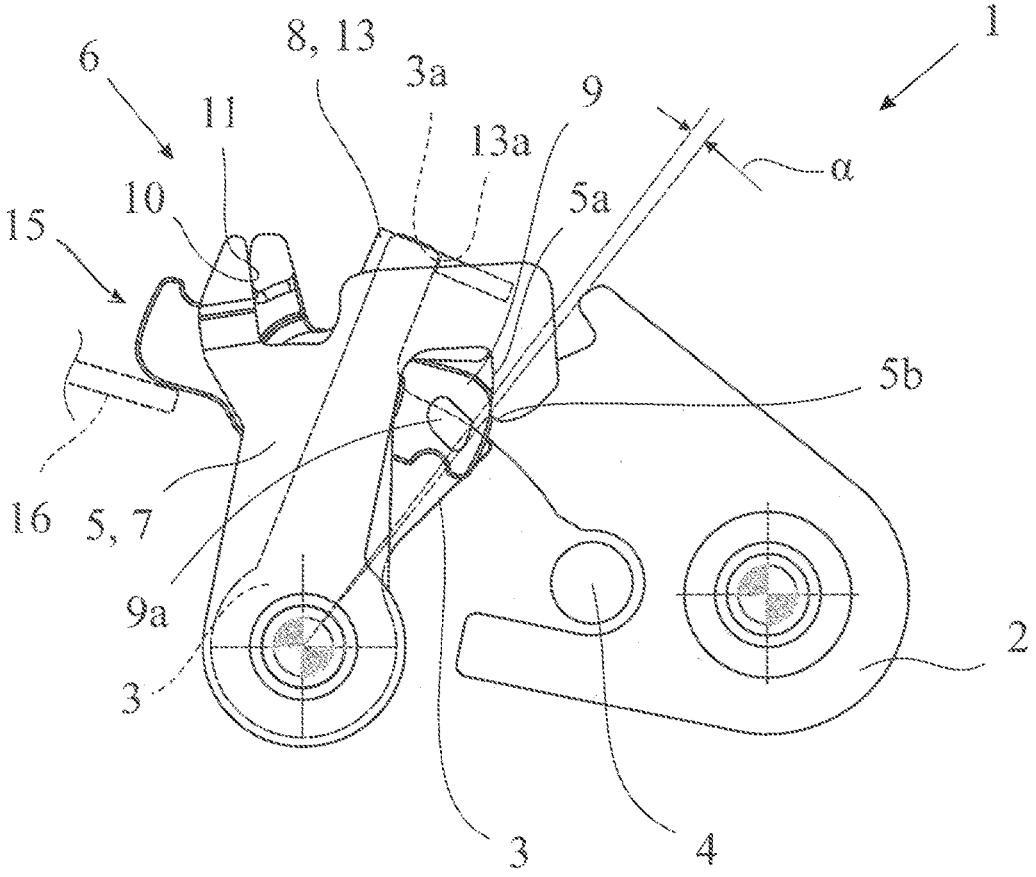

FIGS. 2 and 3 in combination show that a pawl actuation lever 5 is provided for deflecting the pawl 3 into the release position. The pawl actuation lever 5 may be coupled to a door handle, preferably to an outer door handle, such that the assigned motor vehicle door may be opened by actuating the door handle.

Again, FIGS. 2 and 3 in combination show that a switchable coupling arrangement 6 is provided between the pawl actuation lever 5 and the pawl 3, wherein the switchable coupling arrangement 6 comprises a first coupling lever 7 on the side of the pawl actuation lever 5, a second coupling lever 8 on the side of the pawl 3 and a movable coupling element 9 that may be moved into a closing position (FIG. 4) for a coupling engagement with the two coupling levers 7, 8 and into an opening position (FIG. 3) for decoupling the two coupling levers 7, 8. FIGS. 1 and 2 in combination show that the coupling element 9 is arranged on the second coupling lever 8 and that, in its closing position, the coupling element 9 comes into coupling engagement with the first coupling lever 7, which here and preferably is the pawl actuation lever 5. As a result, in the situation of FIG. 4, the coupling element 9 is in coupling engagement with both of the coupling levers 7, 8 such that actuation of the first coupling lever 7, here and preferably the pawl actuation lever 5, leads to the same actuation of the second coupling lever 8. For this engagement the coupling element 9 comprises a coupling surface 9*a* in the form of a pin, while the pawl actuation lever 5 comprises a coupling surface 5*a* in the form of a hook.

As noted above, the coupling element 9 is arranged on one of the two coupling levers 7, 8. Releasing the pawl actuation lever 5 from its actuated state (FIG. 4) into its non-actuated state (FIG. 3) causes engagement of a control surface 10 of the coupling element 9 with a counter control surface 11, which here and preferably is located at the first coupling lever 7, namely the pawl actuation lever 5. The engagement of the control surface 10 with the counter control surface 11 is such that the coupling element 9 is forced into its opening position (FIG. 3) and that deflecting the pawl actuation lever 5 from its non-actuated state (FIG. 3) into its actuated state (FIG. 4) releases the coupling element 9 into its closing position. As noted above the coupling element 9 is preferably arranged on the second coupling lever 8 on the side of the pawl 3. This may be taken from FIG. 2.

The coupling element 9 is pivotable around a coupling element axis 12 which is accordingly located on the second coupling lever on the side of the pawl 3.

In the shown and insofar preferred embodiment the first coupling lever 7 of the switchable coupling arrangement 6 is the pawl actuation lever 5 as noted above and the second coupling lever 8 is here and preferably a pawl release lever 13 connected to the pawl 3. The connection between the pawl release lever 13 and the pawl 3 may best be seen from the FIGS. 1 and 2 in combination. The pawl release lever 13 comprises an engagement surface 13*a* which is or may be brought in engagement with a counter engagement surface 3*a* at the pawl 3. Accordingly pivoting the pawl release lever 13 in clockwise direction in FIG. 1 leads to a corresponding pivoting of the pawl 3 in clockwise direction. As may be seen from FIG. 1 this connection between the pawl 3 and the pawl release lever 13 is only provided in the release direction of the pawl 3 and, in the non-actuated state, may even include a gap between the engagement surface 13*a* and the counter engagement surface 3*a*. Insofar the expression "connection" between the pawl release lever 13 and the pawl 3 may be understood in a broad sense.

In a further preferred embodiment not shown in the drawings a pawl release lever 13 is omitted. This is possible if the pawl 3 itself provides the second coupling lever 8 which in a further preferred embodiment carries the coupling element 9. With this the construction of the motor vehicle lock would be even more cost efficient due to less components.

The switchable coupling arrangement 6 here and preferably is pretensioned into its closing state such that deflecting the pawl actuation lever 5 from its non-actuated state (FIG. 3) into its actuated state (FIG. 4) in normal operation causes closing of the switchable coupling arrangement 6. In further detail, it is preferred that the coupling element 9 is pretensioned into the closing position, in FIG. 3-5 into an anticlockwise direction, such that deflecting the pawl actuation lever 5 from its non-actuated state (FIG. 3) into its actuated state (FIG. 4) in normal operation causes closing of the switchable coupling arrangement 6. The pretension of the coupling element 9 is preferably realized by a spring arrangement 9*b* shown in FIG. 2.

Generally the counter control surface 11 which is interacting with the control surface 10 of the coupling element 9 may be arranged at a fixed housing part of the motor vehicle lock. It is preferred, however, that the counter control surface 11 is arranged at the pawl release lever 13. Generally, the counter control surface 11 may be arranged at the pawl 3 itself, especially if the pawl release lever 13 is being omitted as noted above.

Figure 4:
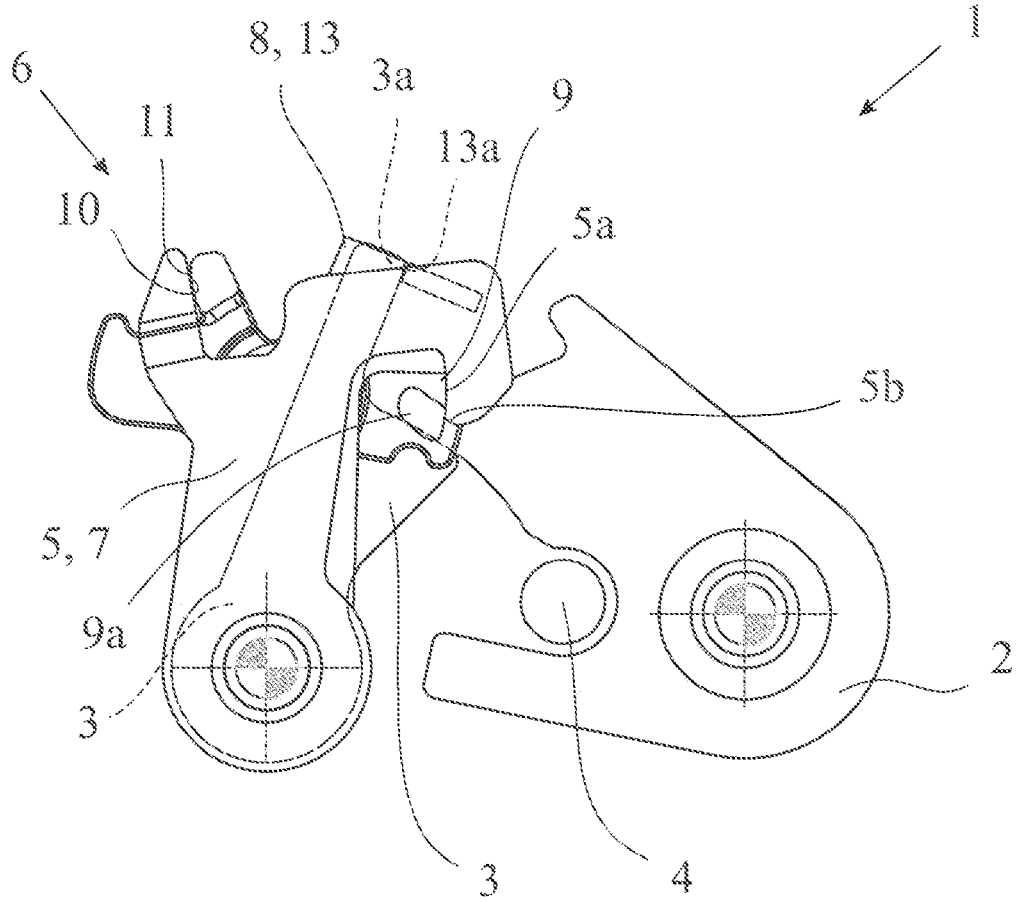

It may be seen in FIG. 3 that with the pawl actuation lever 5 being in the non-actuated state closing the switchable coupling arrangement is being blocked by the engagement of the control surface 10 and the counter control surface 11. In further detail, in the situation in FIG. 3, closing the switchable coupling arrangement 6 would only be possible by turning the coupling element 9 in an anti-clockwise direction into the position somewhat as shown in FIG. 4. The pawl actuation lever 5 here and preferably is pretensioned into the non-actuated state, in the drawings in the clockwise direction, such that the transfer of the coupling element 9 into its closing position is blocked by the engagement of the control surface 10 and the counter control surface 11. In this respect, the configuration is such that the pretensioning of the pawl actuation lever 5 dominates the pretensioning of the coupling lever 9.

The pretension of the coupling element 9 as well as the pretension of the pawl actuation lever 5 are each preferably realized by spring arrangements. The spring arrangement 9*b* assigned to the coupling element 9 is shown in FIG. 2 as noted above.

Figure 5:
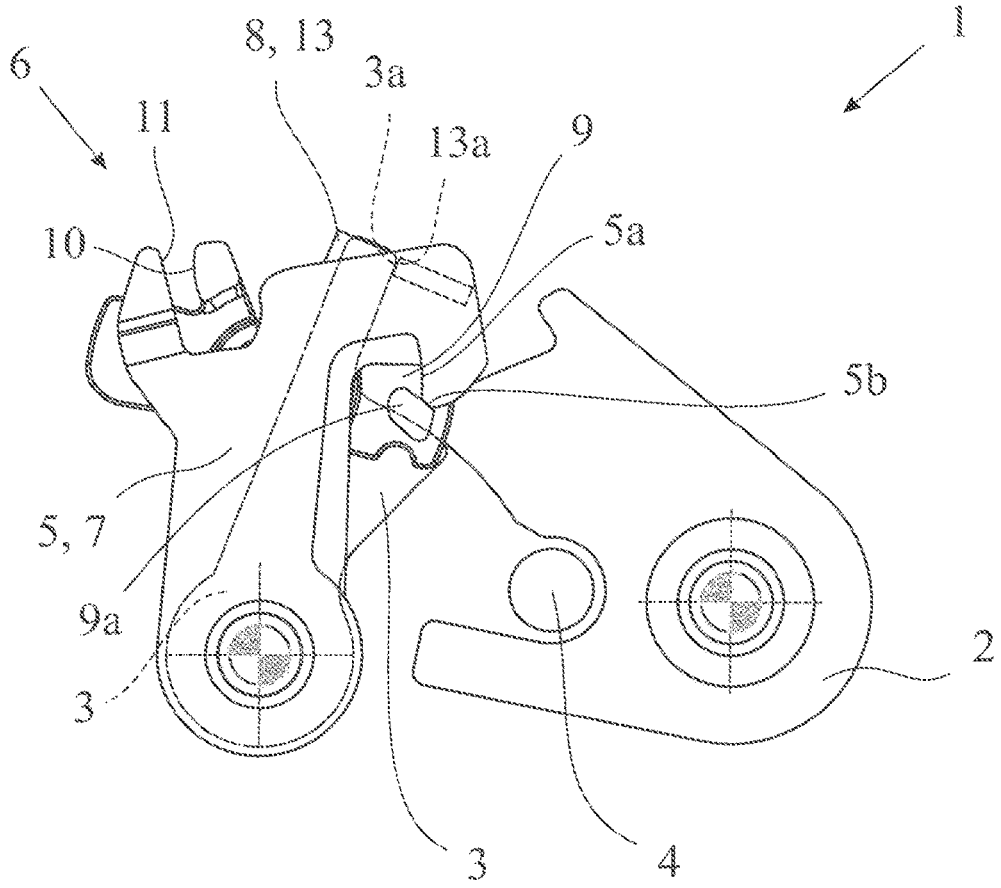

FIG. 5 shows a situation in which the deflection of the pawl actuation lever 5 from its non-actuated state into its actuated state is being performed with a rapidity that is above a threshold rapidity, preferably induced by a crash. Here the coupling element 9, after a first actuation of the pawl actuation lever 5, travels into the direction of the closing position, driven by its pretension. However, due to the mass inertia regarding the mass of the coupling element 9, this movement of the coupling element 9 is delayed in such a way that the pawl actuation lever 5 runs free. As a result the crash induced actuation of the pawl actuation lever 5 has not led to the deflection of the pawl 3 into its release position.

According to the above the actuation of the pawl actuation lever 5 firstly comprises a release section of movement of the pawl actuation lever 5, during which the coupling element 9 is being released to move into its closing position. This first section of movement is indicated in FIG. 3 with the angle $\alpha$ (alpha).

The first section of movement is followed by a subsequent pawl deflecting section of movement of the pawl actuation lever 5, during which the pawl 3 is being deflected into its released position if the coupling element 9 has reached its closing position during the release section of movement.

Interesting is now the aspect that the pawl actuation lever 5, while in the pawl deflecting section of movement, prevents the coupling element 9 from reaching its closing position. For this the pawl actuation lever 5 comprises a blocking surface 5*b* that does not allow a counter blocking surface, which in the shown embodiment is the coupling surface 9*a*, of the coupling element 9 to pass into the direction of the closing position.

Here and preferably the mass inertia based delay regarding closing of the switchable coupling arrangement 6 goes back mainly on the weight distribution of the coupling element 9. Accordingly the delay and the above noted threshold rapidity may be configured easily just by changing the weight distribution of the coupling element 9.

FIGS. 2 and 3 shows in combination that the pawl actuation lever 5 and the pawl release lever 13 are pivotable around one and the same geometrical pivot axis 14. This makes a particularly compact arrangement.

In a further preferred embodiment a lock mechanism 15 is provided, which may be brought into different functional states such as "unlocked" and "locked" via a lock actuation arrangement 16 indicated in FIG. 3. Those functional states are useful during normal operation, in particular when a door handle, which is connected to the pawl actuation lever 5, shall be enabled or disabled regarding deflecting of the pawl 3. The lock mechanism 15 with its lock actuation arrangement 16 acts on the switchable coupling arrangement 6 for realizing the functional states "unlocked" and "locked" such that the switchable coupling arrangement 6 closes in the functional state "unlocked" and opens in the functional state "locked".

It may be seen in FIG. 3 that to realize the functional state "locked" the lock actuation arrangement 16 has to hold the coupling element 9 in the position shown in FIG. 3 without interfering with the movement of the pawl actuation lever 5. For realizing the functional state "unlocked" the lock actuation arrangement 16 simply has to be removed from the position shown in FIG. 3. With this simple arrangement not only the above noted crash function, but also a locking/unlocking function may be realized.

Finally it may be pointed out that the proposed solution is not only applicable to a motor vehicle lock 1 that is actuated manually by actuating a door handle. In the case that the pawl actuation lever 5 is drivable by a motor drive, a crash induced actuation of the pawl actuation lever 5 with high rapidity accordingly leads to the pawl actuation lever 5 running free as noted above.

The invention claimed is:

1. A motor vehicle lock for a motor vehicle door arrangement, wherein a catch and a pawl, which is assigned to the catch, are provided, wherein the catch can be brought into an opening position and into a closed position, wherein the catch, which is in the closed position, is or may be brought into holding engagement with a lock striker, wherein the pawl may be brought into an engagement position, in which it is in blocking engagement with the catch wherein the pawl may be deflected into a release position, in which it releases the catch, wherein a pawl actuation lever is provided for deflecting the pawl into the release position, wherein a switchable coupling arrangement is provided, wherein the switchable coupling arrangement comprises the pawl actuation lever, a pawl release lever on the side of the pawl and a moveable coupling element that may be moved into a closing position for a coupling engagement with the pawl actuation lever and the pawl release lever and into an opening position for decoupling the pawl actuation lever and the pawl release lever, wherein the coupling element is arranged on the pawl release lever and wherein releasing the pawl actuation lever from its actuated state into its non-actuated state causes engagement of a control surface of the coupling element with a counter control surface on the pawl actuation lever such that the coupling element is forced into its opening position and wherein deflecting the pawl actuation lever from its non-actuated state into its actuated state releases the coupling element into its closing position.

2. The motor vehicle lock according to claim 1, wherein the coupling element is arranged on the pawl release lever on the side of the pawl.

3. The motor vehicle lock according to claim 1, wherein the coupling element is pivotable on the pawl release lever on the side of the pawl.

4. The motor vehicle lock according to claim 1, wherein the switchable coupling arrangement is pretensioned into the closing state such that deflecting the pawl actuation lever from its non-actuated state into its actuated state in normal operation causes closing of the switchable coupling arrangement.

5. The motor vehicle lock according to claim 1, wherein the coupling element is pretensioned into the closing position such that deflecting the pawl actuation lever from its non-actuated state into its actuated state in normal operation causes closing of the switchable coupling arrangement.

6. The motor vehicle lock according to claim 1, wherein the counter control surface is arranged at the pawl release lever or the pawl itself.

7. The motor vehicle lock according to claim 1, wherein with the pawl actuation lever being in the non-actuated state closing the switchable coupling arrangement is being blocked by the engagement of the control surface and the counter control surface.

8. The motor vehicle lock according to claim 1, wherein the pawl actuation lever is pretensioned into the non-actuated state.

9. The motor vehicle lock according to claim 1, wherein deflecting the pawl actuation lever from its non-actuated state into its actuated state with a rapidity that is above a threshold rapidity, the pawl actuation lever runs free due to the mass inertia based delay in closing of the switchable coupling arrangement.

10. The motor vehicle lock according to claim 1, wherein the actuation of the pawl actuation lever comprises a release section of movement of the pawl actuation lever, during which the coupling element is being released to move into its closing position, and a subsequent pawl deflecting section of movement of the pawl actuation lever, during which the pawl is being deflected into its released position if the coupling element has reached its closing position during the release section of movement.

11. The motor vehicle lock according to claim 1, wherein the mass inertia based delay in closing of the switchable coupling arrangement goes back mainly on the weight distribution of the coupling element.

12. The motor vehicle lock according to claim 1, wherein the pawl actuation lever and the pawl release lever are pivotable around one and the same geometrical pivot axis.

13. The motor vehicle lock according to claim 1, wherein a lock mechanism is provided, which may be brought into different functional states such as “unlocked” and “locked” via a lock actuation arrangement and wherein the lock mechanism acts on the switchable coupling arrangement for realizing the functional states “unlocked” and “locked” such that in the functional state “unlocked” the switchable coupling arrangement closes and in the functional state “locked” opens.

14. The motor vehicle lock according to claim 9, wherein a crash causes deflecting the pawl actuation lever from its non-actuated state into its actuated state with a rapidity that is above a threshold rapidity.

* * * * *